US006375397B1

(12) United States Patent
Lotz

(10) Patent No.: US 6,375,397 B1
(45) **Date of Patent: *Apr. 23, 2002**

(54) CONTINUOUS STEEL CASTING INSTALLATION WITH DEBURRER FOR CUTTING BURRS AND CUTTING BEADS ON SLABS, BLOOMS AND BILLETS

(75) Inventor: Horst K. Lotz, Hofheim-Wallau (DE)

(73) Assignee: Gega Corporation, Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,950

(22) Filed: Jan. 13, 1999

(30) Foreign Application Priority Data

Jan. 13, 1998 (EP) ..... 97106544

(51) Int. Cl.[7] ..... B23C 3/12; B23D 5/02

(52) U.S. Cl. ..... 409/139; 409/301; 409/346; 29/81.05; 29/33 A

(58) Field of Search ..... 409/300, 139, 409/301, 297, 298, 326, 346; 29/33 A, 81.05, 81.01; 164/70.1, 263; 228/13; 299/62

(56) References Cited

U.S. PATENT DOCUMENTS

| | | | | | |
|---|---|---|---|---|---|
| 900,950 | A | * | 10/1908 | Proctor | 299/62 |
| 1,201,097 | A | * | 10/1916 | Proctor | 299/62 |
| 1,839,391 | A | * | 1/1932 | Howser | 409/139 |
| 2,521,199 | A | | 9/1950 | Babcock | |
| 3,377,896 | A | | 4/1968 | de Corta | |
| 3,515,029 | A | | 6/1970 | Gambini | |
| 3,970,406 | A | * | 7/1976 | Kubicek | 408/127 |
| 3,981,540 | A | * | 9/1976 | Hawkes | 299/62 |
| 4,052,107 | A | * | 10/1977 | Hay | 299/62 |
| 4,203,183 | A | * | 5/1980 | Pavlovsky | 29/33 A |
| 4,357,817 | A | | 11/1982 | Linsinger | |
| 4,362,448 | A | | 12/1982 | Hasebe et al. | |

(List continued on next page.)

FOREIGN PATENT DOCUMENTS

| | | | | |
|---|---|---|---|---|
| DE | 2654934 | * | 12/1976 | 409/139 |
| DE | 3638068 | * | 5/1988 | 409/139 |
| EP | 0 463 201 A1 | | 6/1990 | |
| EP | 0 671 230 B1 | | 3/1994 | |
| JP | 56-21712 | | 2/1981 | |
| JP | 58-71022 | | 4/1983 | |
| JP | 402048154 A | * | 2/1990 | |
| JP | 3210951 | | 9/1991 | |
| RU | 1389946 | | 12/1985 | |

*Primary Examiner*—A. L. Wellington
*Assistant Examiner*—Erica E Cadugan
(74) *Attorney, Agent, or Firm*—Brij K. Agarwal; Eckert Seamans Cherin & Mellott, LLC

(57) ABSTRACT

A deburrer machine for cutting burrs (2), which consists out of a rotating deburring body (3) and travelling carriage (6) is foreseen for application especially on longitudinally cut slabs in flow. For deburring the deburring pistons (4) perform a rotary movement around the deburring body axis (21), whereby they approach to the cutting burr (2) from the workpiece side. Therefore the rotation axis is arranged in a way that the deburring pistons (4) turn below the lower workpiece surface outside the workpiece (1) after having finished the deburring procedure in order to lift again against this lower surface. Inside the deburring body (3) is placed a pressure chamber (18) which effects the lifting of the deburring pistons (4). Thereby the air contained in the lower piston guidance (12) is displaced and then the throttled air is led-off via bores in the lower part of the deburring piston (4) in order to dampen the piston movement. The one-piece design of the deburring piston (4) and the deburring cap (25) promises wear- and repair advantages. Other designs of rotating deburrers which derive from the above described promise simpler and on request less space-consuming possibilities.

6 Claims, 6 Drawing Sheets

U.S. PATENT DOCUMENTS 4,478,296 A * 10/1984 Richman, Jr. ..... 299/62
4,672,726 A 6/1987 Delbecq et al.
4,704,241 A 11/1987 Boggs
5,179,772 A 1/1993 Braun et al.
5,259,440 A 11/1993 Lotz et al.
5,520,241 A * 5/1996 Meunier et al. ..... 164/263
5,597,030 A 1/1997 Lotz et al.
5,626,181 A 5/1997 Lotz et al.
5,765,271 A 6/1998 Lotz et al.
6,070,311 A * 6/2000 Lotz ..... 29/33 A

* cited by examiner

CONTINUOUS STEEL CASTING INSTALLATION WITH DEBURRER FOR CUTTING BURRS AND CUTTING BEADS ON SLABS, BLOOMS AND BILLETS

FIELD OF THE INVENTION

A deburring installation, briefly named deburrer, is combined with or installed after a continuous steel casting installation for removal of cutting burrs (2) developed by a thermochemical longitudinal or cross cutting of strands, the deburrer having cylindrical deburring pistons (4) or tiltable deburring caps (25) which are placed in a rotatably supported deburring body (3) and pushing the cutting burr (2) off by a rotating movement of the deburring body (3).

BACKGROUND OF THE INVENTION

During cutting with oxygen, especially in continuous steel casting installations, there arise more or less big burrs, which develop at the two lower cutting edges, consisting out of a mixture of brittle iron oxides and hard to elastic steel, at the beginning and the end of each workpiece (1) because of the down flowing and partly cooling cutting slag. Parts of those burrs hang down deeply from the edges like icicles, other parts form relatively flat bulges at the edges of the lower work piece surfaces, otherwise there are all kinds of compositions of both. The form and material composition of all cutting burrs (2) depend on the casting and cutting procedure. In any case those burrs are very disturbing in the further processing, if not already for the further transport. It would be most desirable to avoid such cutting burrs (2) but this cannot be realized. Under certain circumstances a considerable minimization is possible but cannot be predicted with certainty.

As a consequence there exists a number of methods of operation and procedures in order to remove the burrs as soon as possible after their formation, namely, by: melting respectively scarfing by oxygen burners; stricking-off respectively chiselling-off by hand; mechanical knocking-off with quickly rotating, hammer-like tools; mechanical shearing-off with fixed or horizontally swinging, shear blade-like tools; mechanical shearing-off with linearly moved, piston-like tools.

While the scarfing type deburring procedures mainly show the advantages of high deburring speeds, they have considerable disadvantages like fume formation, slag splashes, granulation water requirements as well as the danger of fire and explosion. Therefore the demand turns more to mechanical deburring possibilities where besides of the costs for mechanical equipment and energy only the considerable time requirements and the discharge of the deburred burrs have to be considered.

A reliable and successfully working deburrer is described in EPA 90 11 20 27.9. For the first time this deburrer applies individually operated deburring pistons (4), which are supported in a deburring body (3) and can adapt to vaulted workpiece surfaces and thus considerably improves the deburring success. However, this installation is also costly and does require intensive maintenance; the exchange of the deburring pistons (4) is difficult and time-consuming. Furthermore burrs from longitudinal cutting and of more complicated cross sections cannot be removed at all or only with a lot of difficulties.

The deburring machine according to EP 0 671 230 A1 shows a considerable improvement because the deburring pistons (4) are no longer individually supplied with high pressure compressed air but are supported in a deburring body (3) which is designed as a tube-type body. The whole so-called deburring body (3) is pressurized via an air pipe, so that all deburring pistons (4) lift at the same time. With this solution it is important that the pressure is considerably lower than with the first mentioned installation and that the deburring pistons (4) press against the lower surface of the workpiece (1) following its shape using the lifting movement of the deburring body (3), which is produced via simple lifting cylinders (30) before every deburring procedure.

In contrast to the before describe deburrer the deburring piston (4) does not contact flatly—which means in an angle of 90 to the workpiece (1)—but only with one edge because of a slight tilting of the deburring body (3). Thus the contact pressure and as a consequence the pressure in the deburring body (3) can be considerably reduced. Moreover a safer because limitated contact of the protuding, sickle-shaped cutting blade is achieved without being influenced by eventual roughness of the lower workpiece surface and subsequently a smallest shearing force.

In addition the design of the deburring pistons (4) allows to install them all from the same side which reduces the maintenance requirements considerably.

Nevertheless the still existing great disadvantage is that the working movement during the deburring procedure, which means the relative movement between deburrer and workpiece (1), can be produced in only two different ways.

It is possible to design a stationary machine and thus allowing a relatively simple construction, with the result that the deburring of the front work piece side in flow direction requires a time-consuming return movement of the workpiece (1).

Or the deburrer is designed as travelling installation with the result of higher cost and the disadvantage of increased space requirements. This explains the poor application of such installations in multiple strand installation for smaller sizes (i.e. billets).

Further development requirements result from the fact that the deburring of strands which were cut longitudinal in flow direction is extremely complicate, as they can only be treated sectionwise and not continuously with such a machine.

BRIEF DESCRIPTION OF THE DRAWINGS

The preferred embodiments of the invention, illustrative of the best modes in which Applicant has contemplated applying the principles of the invention, are set forth in the following description and are shown in the drawings and are particularly and distinctly pointed out and set forth in the appended claims.

Similar numerals refer to similar parts throughout the specification.

DETAILED DESCRIPTION

Figure 1:
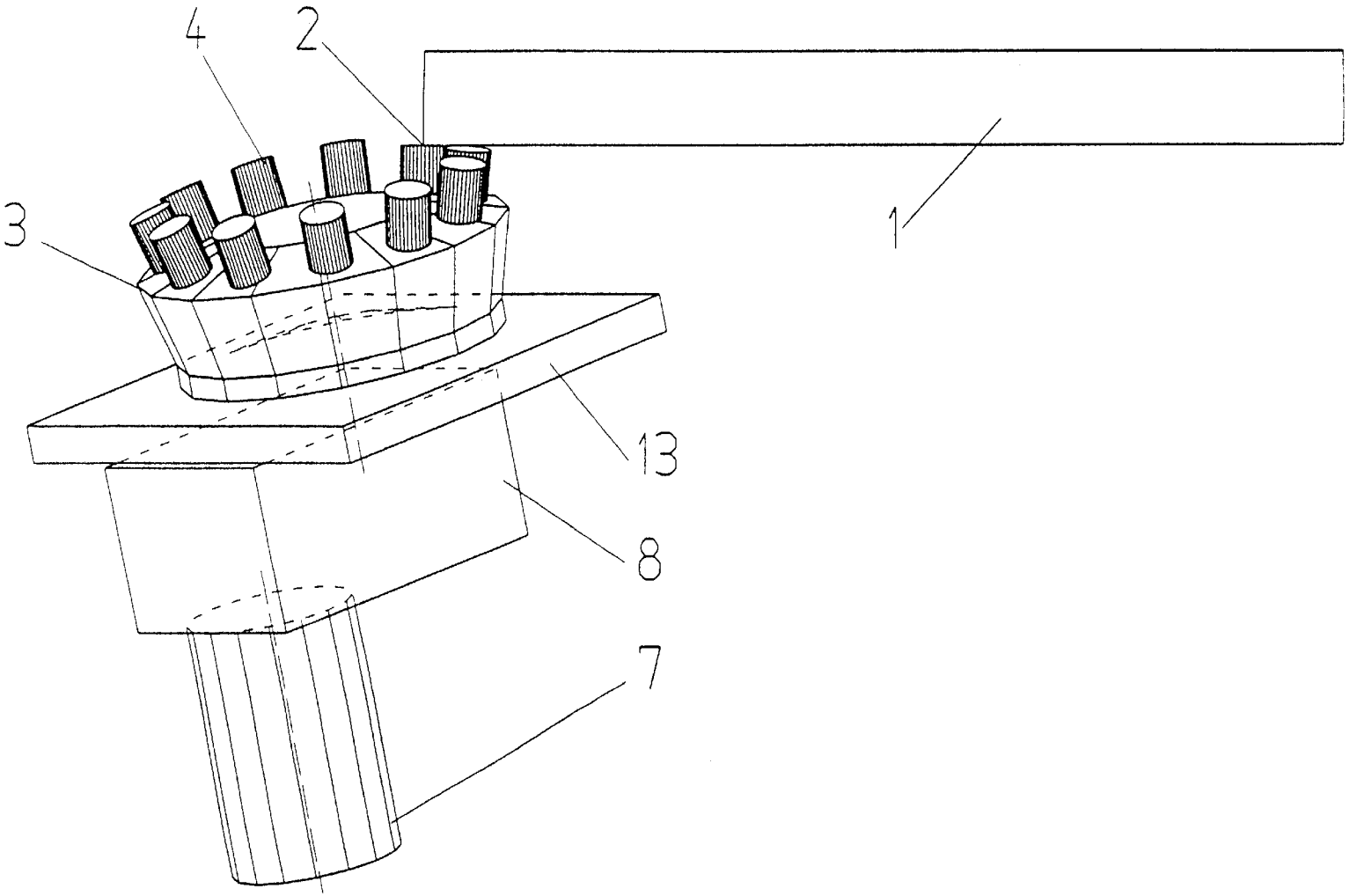
FIG. 1 is a perspective view of a deburring apparatus in accordance with the present invention.

The invention described in the following consists for example, as shown in FIGS. 1–4, of a rotation-symmetrical hollow body, the deburring body (3). The chamber (18) which is situated in its centre is supplied with a pressure medium—preferably air—in order to lift the deburring pistons (4). Thereby the air in the lower guide bush (11) is displaced and discharged via bores in the deburring piston (4) with connected throttle (23) to dampen the piston movement. According to FIG. 4 it is also possible to form the pressure chamber (18) by a section (124) which is welded on the lower end of the deburring body (103) whereby the chamber (19) in the deburring body interior becomes usable for creation of a counter-pressure $p_2$ with which the deburring piston (4) can be retracted again.

The lifting pressure $p_1$ is kept permanently and only reduced for a possibly required reentering of the deburring pistons (4). In order to produce the necessary relative movement between deburrer and workpiece (1) in deburring direction, the deburring body (3), which is driven by an electric or hydraulic motor (7), if required by gearbox (8) and drive shaft (9), rotates around its axis (21).

The latter are installed in the upper part of a multi-part machine frame which consists of base plate (10), guide bush (11) and the support (13).

The gearbox (8) of the drive unit is screwed on the base plate (10). The guide bush (11) serves as reception for the main drive shaft (9) which is realized as hollow shaft and for the deburring body bearing (14). The deburring body (3) is rigidly connected with the guide bush (11) via a connecting piece (15) which is welded onto the shaft (9). In addition, the connecting piece (15) has cross bores (16) through which the deburring body (3) is supplied with the pressure medium, preferably air. The supply with the pressure medium is effected via the hollow shaft (9) and a rotary joint (17) which is fixed at its lower end.

In order to be able to achieve a controlled damping of the lifting of the deburring pistons (4) at constant pressure, the piston guide (12) is designed such that it forms a closed chamber, together with the deburring piston (4) to be guided and via a sliding shoe with sealing, which is pressure released via a throttle (23).

The deburring body (3) can also be designed in a different way, for example a centrically bent pipe which rotates around the axis (21) in a fan-like way.

This axis (21) must be inclined in a way that the deburring pistons (4) do only lie shortly on the workpiece surface at the beginning of the deburring procedure and that they are pressed back into the deburring body (3) with approaches to the cutting burr (2) in order to compensate height variations in respect to the workpiece (1).

As a consequence of the permanently present air pressure, the deburring pistons (4) jump out of the deburring body (3) after conclusion of the deburring procedure until the retaining ring (32), retained by springs (125), strikes the piston guidance (12). Caused by the rotation of the deburring body (3) around its axis (21) the deburring pistons (4) move underneath the workpiece surface to prevent a collision with the vertical surface of the workpiece (1) during the return movement.

Figure 3:
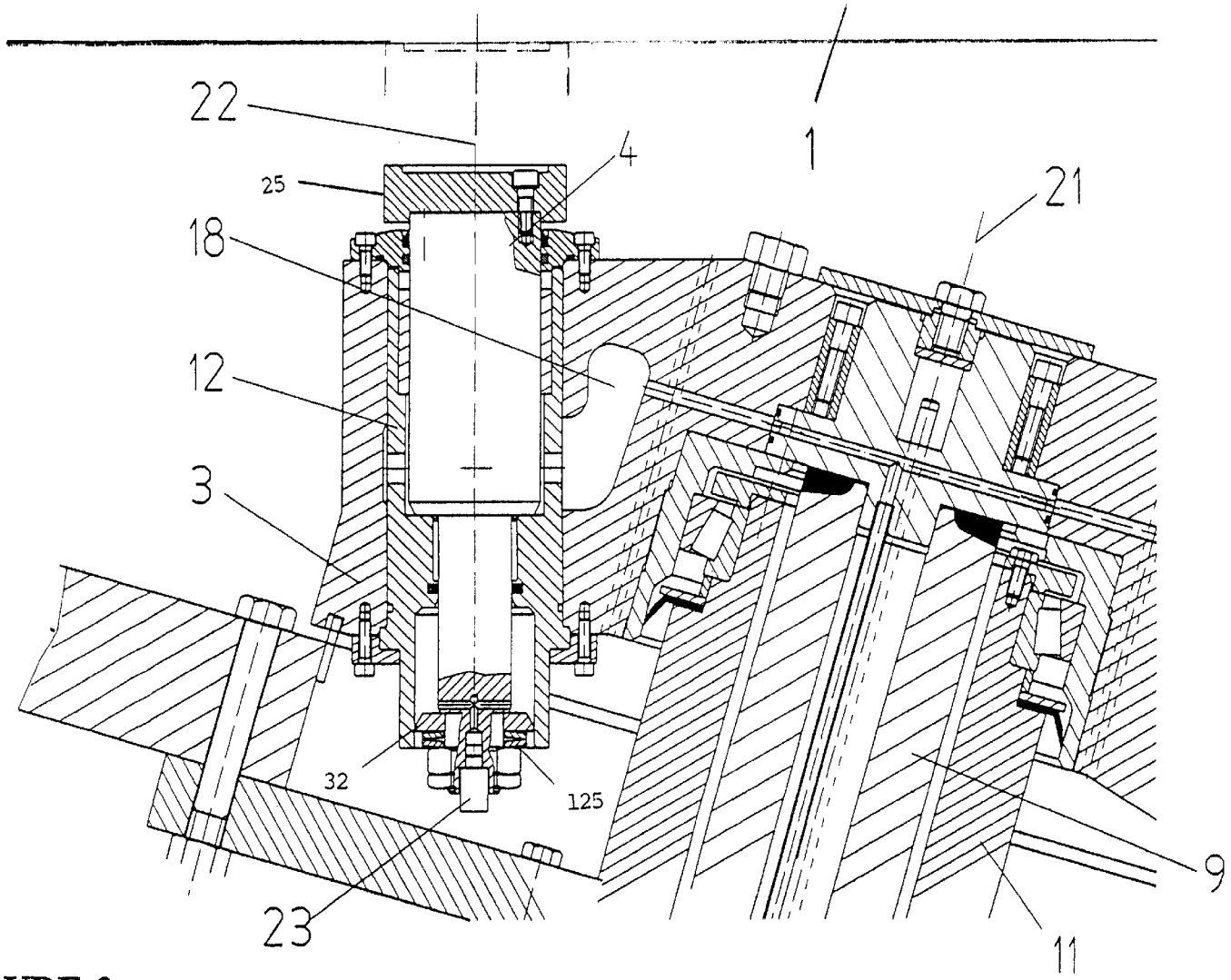
FIG. 3 is an enlarged view of a portion of FIG. 2.
Figure 4:
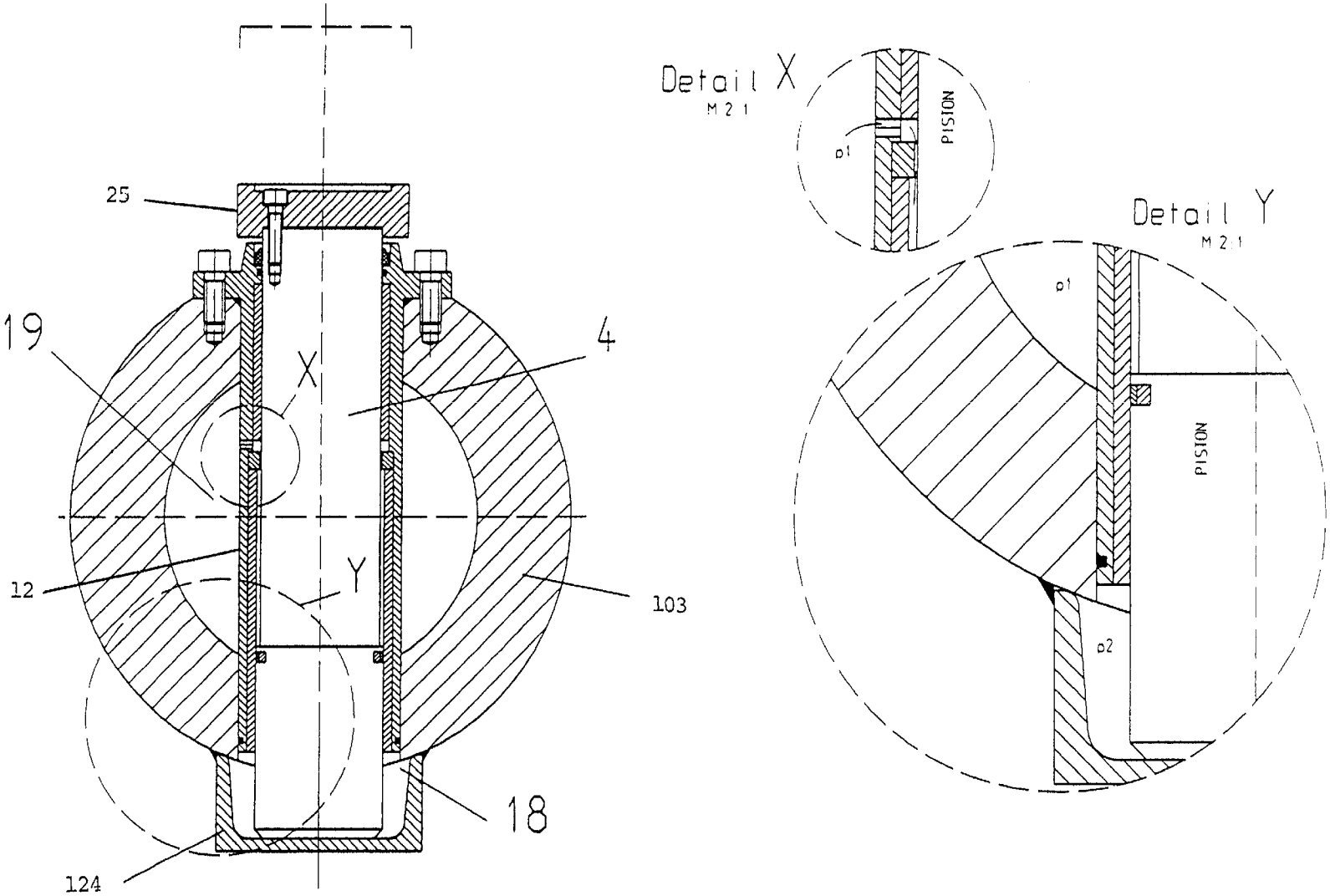
FIG. 4 is an elevational view, partially cut away, of a different configuration of a deburring body in accordance with the present invention and incorporating a deburring piston.

Nevertheless, in order to keep a rectangular angle between the deburring pistons (4) and the workpiece (1) during the deburring procedure as shown in FIG. 3, the deburring piston axis (22) has to be inclined in comparison to the deburring body axis (21) but not more than 20.

The rotation speed of the deburring body (3) always has to be adapted to the transport speed of the workpiece (1), so that no residual pieces of the cutting burr (2) are left between the permanent, repeating strikes of the single deburring pistons (4) against the cutting burr (2).

Of course hereby the piston diameter, the number of pistons as well as the pitch circle circumference of the deburring pistons (4) are decisive factors.

When the deburring pistons (4) strike the cutting burr (2) they should not be aligned absolutely rectangular to the workpiece (1) but according to EP 0 671 230 A1 should be slightly inclined in an angle smaller than 5 in order to be able to reduce the pressure in the deburring body (3), the contact force and thus the friction force with equal surface pressure.

Figure 5:
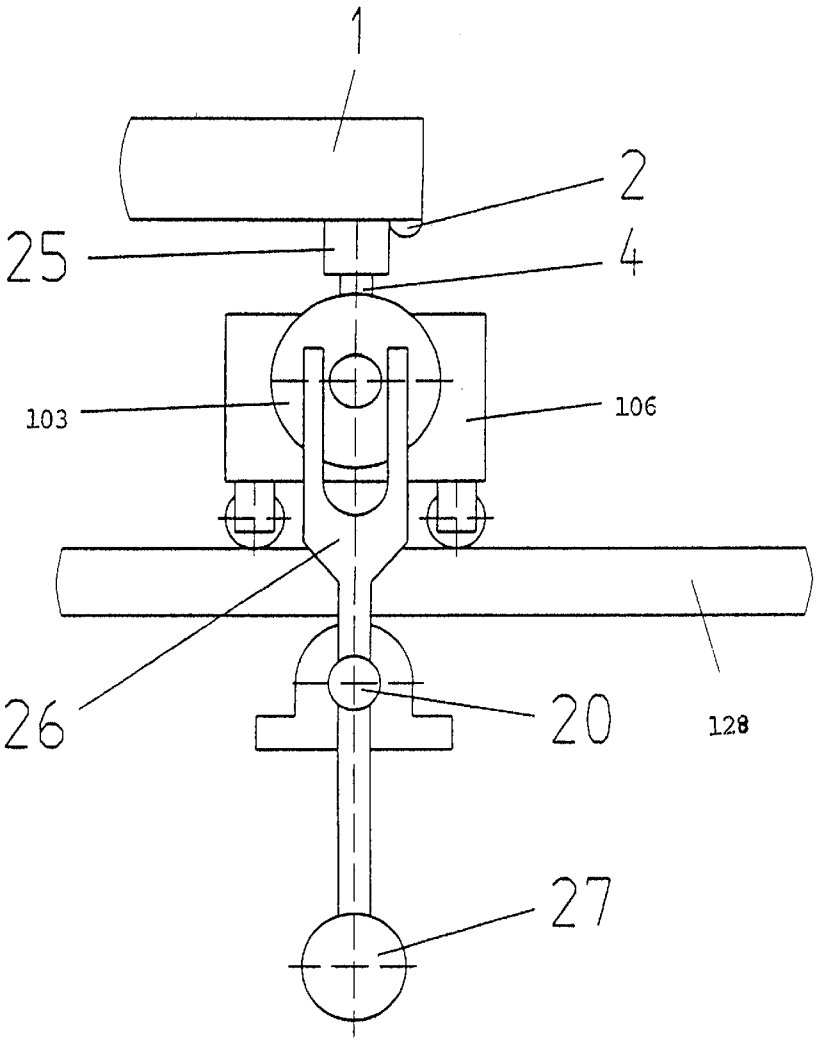
FIG. 5 is an elevational view of a second embodiment of a deburring apparatus in accordance with the present invention.

Another possibility to design a deburrer with rotating deburring movement is shown in FIG. 5.

A deburring body (103) is rigidly or rotatably installed in a carriage (106) which can be moved cross to the cutting burr (2), the deburring pistons (4) with deburring cap (25) are aligned in an angle of 0–5° to the lower surface of the workpiece (1) at the time of the real deburring procedure. The deburring propulsion is created by a drive pendulum (26) whose fork-like upper ends enclose spigots at the carriage (106) or at the deburring body (103) and thus releases a horizontal propulsion force in spite of the rotating movement of the motor- or otherwise driven drive pendulum (26). The working axle (20) of the drive pendulum (26) is also situated outside the real deburring body (103) and the carriage (106) is safely guided horizontally on a sliding rail (128). In order to support the drive and to counterbalance deburring strokes arising at the cutting burr (2), the drive pendulum (26) can be equipped with a swinging body (27) at the prolonged, opposite end of the drive pendulum (26). Otherwise the design of the deburring body (3), the deburring piston (4) and deburring cap (25) can be changed according to the shapes described in EPA 90 11 20 27.9, EP 0 671 230 A1 and as before mentioned.

Figure 6:
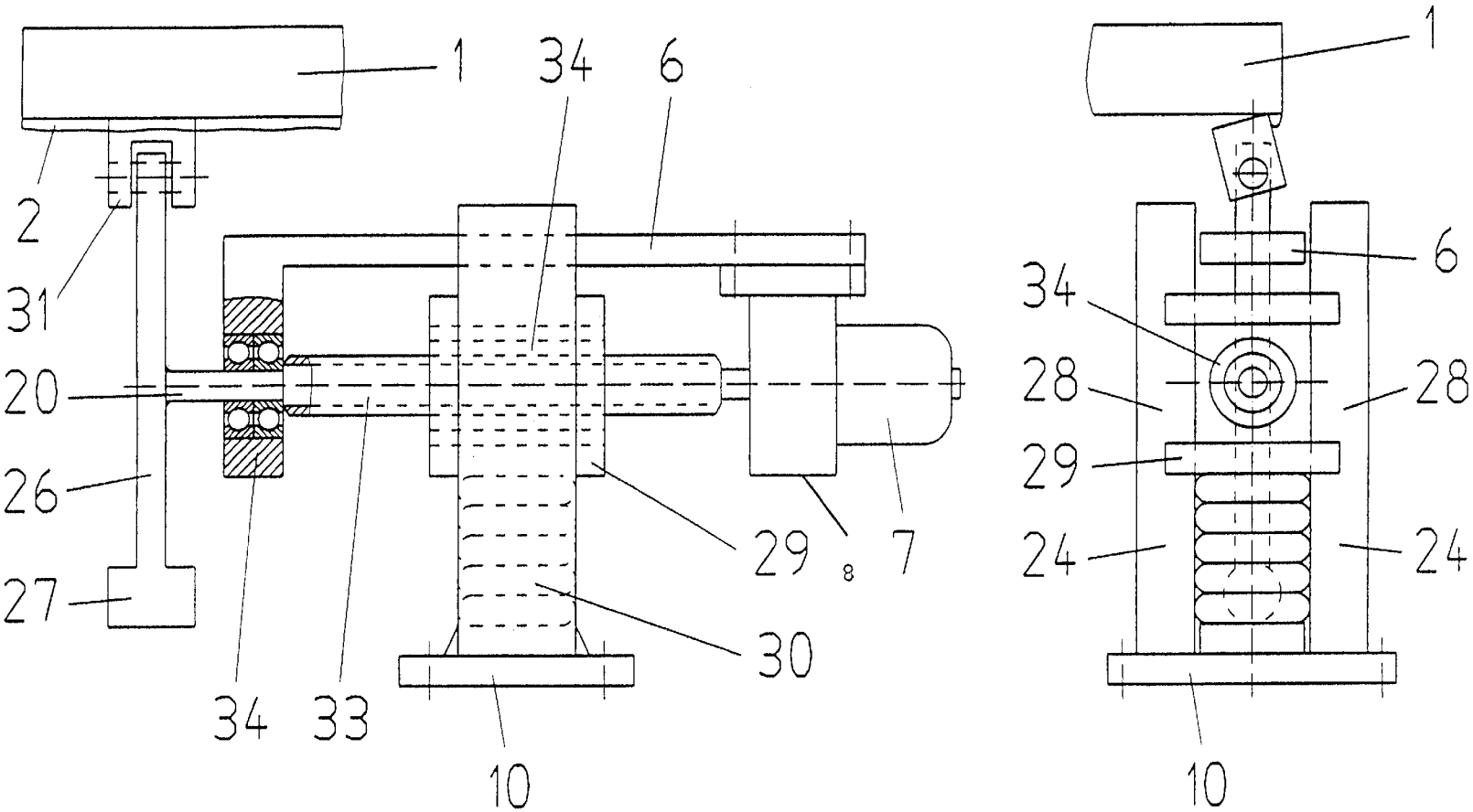
FIG. 6 depicts front and side elevational views of a third embodiment of a burring apparatus in accordance with the present invention.

A third design of a deburrer is that shown in FIG. 6. A tangent slide (29) with lifting cylinder (30) installed below on which a drive pendulum (26) (without fork ends) is fixed together with its motor (7), is placed on a stationary or movable, vertical sliding rail (28). At the upper end of the drive pendulum (26), situated below the workpiece (1), a tiltable round or angular deburring tool (31) is arranged which can be pushed up and against the lower surface of the workpiece (1) together with the whole drive pendulum (26). In case of a rotating movement of the deburring tool (31) the latter is pushed back by the lower surface and thus moves on the tangent at the smallest circle of the drive pendulum (26).

As a liftable drive pendulum (26) with tiltable deburring tool (31) can only be applied up to a limited width because of the vaulted lower surface of wider workpieces (1), small billets being the only exception, a lateral sliding of the deburring system has to put one deburring path besides the other, which becomes possible by a lateral drive, for example a spindle (33), which turns the drive pendulum (26) as a shaft. This spindle (33) is held in a bearing (34) with a motor (7) and sits on a carriage (6), which also serves as torque support and travels on a base plate (10) via 2 guiding U-sections (24), the base plate (10) being at the same time the height guidance for the spindle bearing (34) which rests on the lifting cylinder (30).

The deburring tool (31) has to be tilted to the front when the drive pendulum (26) turns in below the workpiece (1) in order to prevent it from hooking in; therefore the deburring tool (31) is pre-loaded via a spring or a weight.

Figure 2:
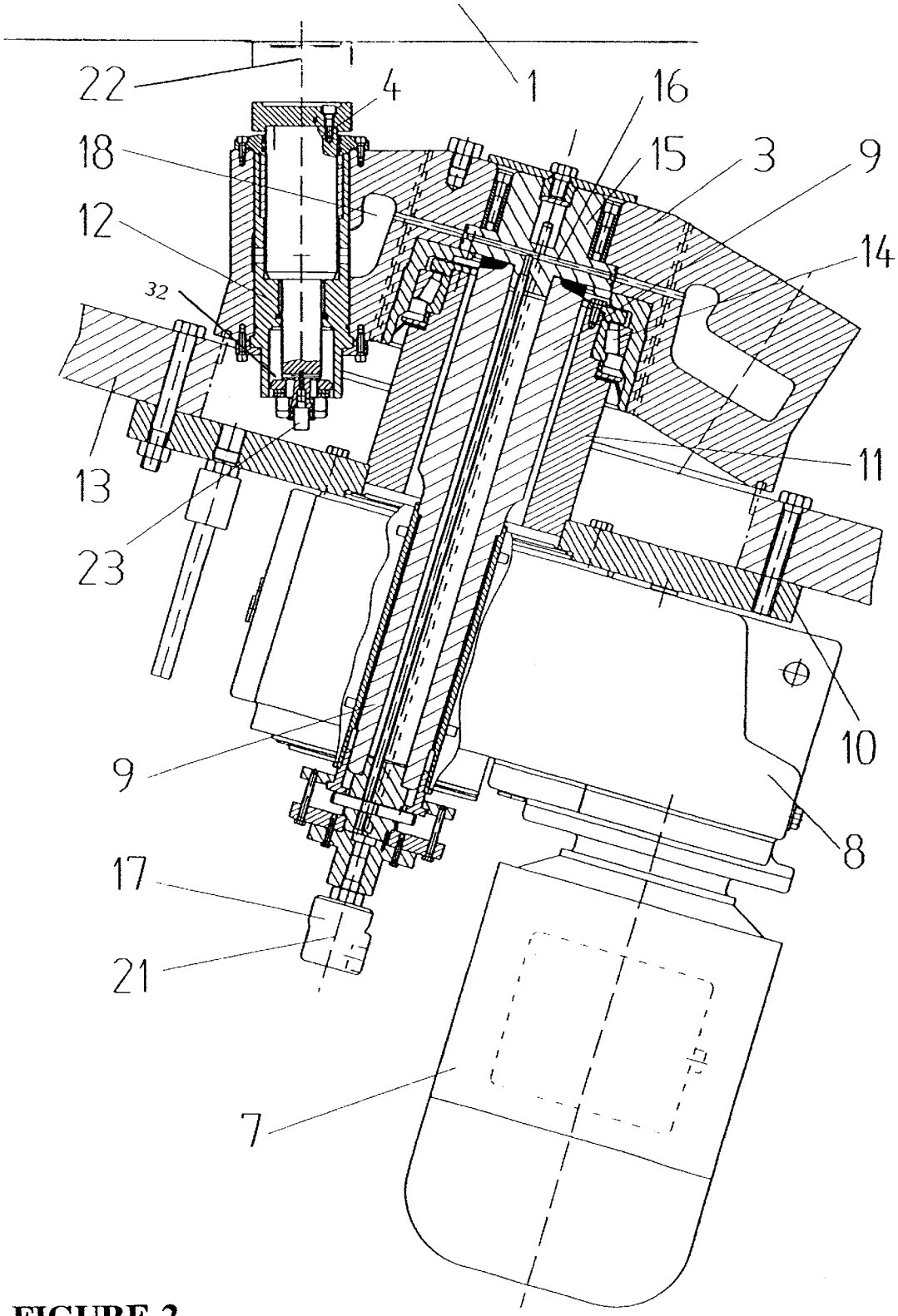
FIG. 2 is an elevational view, partially cut away, of the deburring apparatus.

Normally the guide bush (11), its inside turning deburring piston (4) and the deburring cap (25) are manufactured as individually parts as shown in FIG. 2 and are put together or separated during the final assembly or on the occasion of repair- and maintenance work. Thereby mainly the deburring caps (25) and then the two other parts are considered as wear parts and are manufactured as cheap as possible and kept available, whereby the deburring caps (25) are required in bigger quantities. In contrast to the before described, apparently low-cost individual parts, the subject of this invention is to manufacture the deburring cap (25) and deburring piston (4) as one part, which is pre-installed in the guide bush (11) and equipped with a holder, retaining ring (32). Thus it becomes possible to avoid the costs which formerly arose when being obliged to screw together the required surfaces, steps, bores, bolts and to work on the deburring pistons (4) and deburring cap (25) which were manufactured separately. With the new solution only minor costs for the design of the backward part of the deburring piston (4), for example thread and wholesale article costs for creation of a threaded retaining ring (32), have to be added. The combination of modern manufacture methods with usual craftsman tasks like loading and unloading of the manufacture automaton with 1 instead of 2 parts and the assembly of those parts does not only result in cost disadvantages but it also becomes considerably more difficult and expensive to carry out those craftsman tasks during operational stops on site. On the contrary the joint replacement of pre-assembled guide bushes (11) with deburring piston (4) and retaining ring (32) is considerably simpler and quicker. A workshop replacement only with reusable retaining ring (32) is independant from operation and can be organized at a favourable price.

What is claimed is:

1. A finishing deburring apparatus for removing a burr from a workpiece, the burr protruding outwardly beyond a surface of the workpiece, the deburring apparatus comprising:

a deburring body that is mounted on a frame, the deburring body being rotatable about a rotational axis extending through the deburring body;

a plurality of deburring pistons movably mounted on and circumferentially distributed about the deburring body, each of the deburring pistons being spaced radially on the deburring body from the rotational axis, each deburring piston being movable between extended and retracted positions along a separate longitudinal axis, each longitudinal axis being non-parallel with the rotational axis, but is inclined not more than 20° with respect to the rotational axis.

2. The deburring apparatus as set forth in claim 1, in which at least one of the plurality of deburring pistons includes a deburring cap, the at least one deburring piston and the deburring cap being an indivisible one-piece unit.

3. The deburring apparatus as set forth in claim 1, in which each longitudinal axis is non-parallel with every other longitudinal axis.

4. The deburring apparatus as set forth in claim 1, in which each longitudinal axis is oriented at a common angle with respect to the rotational axis.

5. The deburring apparatus as set forth in claim 1, in which the deburring pistons are structured to deburringly contact the workpiece, and in which each longitudinal axis is inclined at an angle of at most only 5° with respect to an imaginary line extending perpendicularly outward from a plane of the workpiece when each deburring piston is in contact with the burr.

6. The deburring apparatus as set forth in claim 1, in which at least one of the plurality of deburring pistons is fluid biased to the extended position.

* * * * *

UNITED STATES PATENT AND TRADEMARK OFFICE

CERTIFICATE OF CORRECTION

PATENT NO. : 6,375,397 B1
DATED : April 23, 2002
INVENTOR(S) : Horst K. Lotz

It is certified that error appears in the above-identified patent and that said Letters Patent is hereby corrected as shown below:

Column 4,
Line 3, after "20", insert a -- º -- symbol.
Line 36, "(3)" should read -- (103) --.

Signed and Sealed this

Nineteenth Day of November, 2002

*Attest:*

*Attesting Officer*

JAMES E. ROGAN
*Director of the United States Patent and Trademark Office*